United States Patent [19]

Dillan

[11] 4,386,333

[45] May 31, 1983

[54] UNIVERSAL ELECTRICAL CONNECTION APPARATUS

[75] Inventor: George O. Dillan, Boulder County, Colo.

[73] Assignee: International Business Machines Corporation, Armonk, N.Y.

[21] Appl. No.: 317,108

[22] Filed: Nov. 2, 1981

[51] Int. Cl.[3] ..... H01F 27/04

[52] U.S. Cl. ..... 336/107; 323/328; 323/340; 323/341; 336/149; 336/150; 339/18 P; 339/31 M; 339/32 R; 339/32 M; 339/33

[58] Field of Search ..... 336/107, 150, 149; 339/18 P, 31 M, 32 R, 32 M, 33; 323/328, 340, 341

[56] References Cited

U.S. PATENT DOCUMENTS

| | | | |
|---|---|---|---|
| 1,498,146 | 6/1924 | Benjamin . | |
| 2,097,257 | 10/1937 | Schank | 173/361 |
| 2,417,928 | 3/1947 | Guernsey | 173/361 |
| 2,930,019 | 3/1960 | Hubbell | 339/31 |
| 2,989,719 | 6/1961 | Aarlaht | 339/31 |
| 3,034,000 | 5/1962 | Todd | 336/150 X |
| 3,082,302 | 3/1963 | Rumble | 200/51.03 |
| 3,120,985 | 2/1964 | Hubbell | 339/31 M |
| 3,802,159 | 4/1974 | Ferdelman | 55/139 |
| 4,053,788 | 10/1977 | Robie | 307/11 |

FOREIGN PATENT DOCUMENTS

| | | | |
|---|---|---|---|
| 1056222 | 4/1959 | Fed. Rep. of Germany . | |
| 267689 | 4/1966 | Fed. Rep. of Germany | 336/150 |
| 2243825 | 8/1972 | Fed. Rep. of Germany . | |
| 1503482 | 10/1967 | France . | |
| 1545854 | 10/1968 | France . | |
| 7600749 | 8/1976 | Netherlands | 339/32 R |
| 958885 | 5/1964 | United Kingdom | 323/340 X |

OTHER PUBLICATIONS

IBM Technical Disclosure Bulletin, "Copier/Collator Apparatus", A. J. Botte, J. H. Hubbard, J. P. Jordan, H. Kelm, R. J. LeClere and S. W. Zieg, 12/76 pp. 2444, 2445.

IBM Technical Disclosure Bulletin, "Connection Alignment Pin With Selectable Key", C. R. Pettie, pp. 624, 625, 7/72.

J. C. Penney Service Manual, "Black and White Television Model 1038E" (7 pp.) Form No. 2812955-1.

J. C. Penney Manual "Location and Operation of Customer Controls and Battery Model 1038E" (4 pp.), Form No. 2812953-1.

IBM Series III Copier/Duplicator Service Manual, pp. 162, 163, Form No. 241-5928-0.

Electronic Design, 11/22/80, p. 296.

*Primary Examiner*—A. T. Grimley
*Assistant Examiner*—Susan Steward
*Attorney, Agent, or Firm*—Gunter A. Hauptman

[57] ABSTRACT

Different line-cord sets connect an electrical device to different supply voltages, assuring that the supply voltage matches the device. Each line-cord set has a uniquely keyed socket and a wall plug. A device receptacle receives the line-cord's keyed socket. An adjustable key on the device mates with the socket's key and rejects nonmating sockets to admit the socket into the receptacle and adjusts the device's input voltage to match the supply voltage.

6 Claims, 9 Drawing Figures

UNIVERSAL ELECTRICAL CONNECTION APPARATUS

BACKGROUND OF THE INVENTION

1. Field of the Invention

The invention relates to apparatus for connecting an electrical device to a power source and, more particularly, universally adapting a single-voltage device to different source voltages.

2. Description of the Prior Art

Electrical devices, such as copiers, computers, audio components, household appliances, etc., frequently operate on only one voltage but must be used with different power supply voltages. For example, a 115 VAC 60 Hz copier wired with a 115 VAC 60 Hz style plug may have to be used where only a 230 VAC 60 Hz power supply outlet is available. Substitution of a 230 VAC 60 Hz plug together with appropriate wire reconnections permit 115 VAC copier operation from the 230 VAC outlet. However, serious hazards to an operator and machine safety are created. For example, a plug or socket wiring error introduces 230 VAC to copier parts designed for 110 VAC. The reverse situation creates analogous problems. In addition to the hazards of rewiring a 230 VAC device for 110 VAC outlets, the lower supply voltage will probably not effectively operate most 230 VAC devices.

Electrical devices incorporate solutions to some of these problems. The 115 VAC IBM Series III copier connects directly to 230 VAC power supply voltage through appropriate wiring between its internal components and a 230 VAC plug. A line cord adapter, when placed between the 230 VAC plug and a 115 VAC power supply socket, provides essential wiring interconnections, but does not affect the copier's voltage requirements. Voltage switches advertised in ELECTRONIC DESIGN, Nov. 22, 1980, page 296, permit different power supply voltage connections, but do not insure that the switch positions match the connected voltages. IBM TECHNICAL DISCLOSURE BULLETIN, December 1976, pages 2444 and 2445 describe a special circuit for protecting a copier/collator from being inadvertently plugged into the wrong line. Keyed mating plugs and sockets appear in IBM TECHNICAL DISCLOSURE BULLETIN, July 1972, pages 624 and 625, and German Publication No. 2,243,825, Mar. 14, 1974. Alternatively, separate device-mounted sockets for each possible power supply voltage and matching, removable line-cord sets for each power source voltage may be provided with the device. The latter solution requires circuits for removing electrical potential from unused sockets. French Pat. No. 1,545,854 discloses two sockets, one covered, alternately selectable, connected to a power supply voltage changing switch. U.S. Pat. Nos. 2,930,019 and 2,989,719 disclose plugs and sockets adjustable for a plurality of power sources. However, since each must be manually rewired for different voltage sources, a voltage mismatch is possible. Portable radios provide one receptacle both for 110 VAC operation and, specially slotted, for 12 VDC automobile operation. A 12 VDC socket projection switches the power source directly into the radio's DC power supply. In French Pat. No. 1,503,482, a notched dial rests on a plug inserted into an electric razor. While the dial operates a circuit adapting the razor's voltage, operator error connects the wrong power supply voltage.

The prior art does not teach a single device receptacle uniquely mated to each one of a multiplicity of line-cord sets and to the device's power supply, wherein inadvertent mismatches cannot occur.

The invention provides plural plug and socket line-cord sets, usable with a device having a variable power interface, for assuring that the plug's supply voltage matches the device's input voltage. Each line-cord set has two essentially permanently attached end connectors: a keyed socket and a wall plug. The keyed socket has a unique predetermined configuration for the one supply voltage to which the wall plug at the other end is designed to connect. A device receptacle connected to the device's power interface receives the line-cord's keyed socket. An adjustable key on the device mates with the keyed socket's configuration and rejects non-mating line-cord sockets. Adjusting the receptacle's key to mate with the keyed socket plug; (a) admits the line-cord socket into the receptacle and (b) varies the device's power interface to match the device's input voltage to the supply voltage for which the wall plug is designed.

DETAILED DESCRIPTION

Figure 1A:
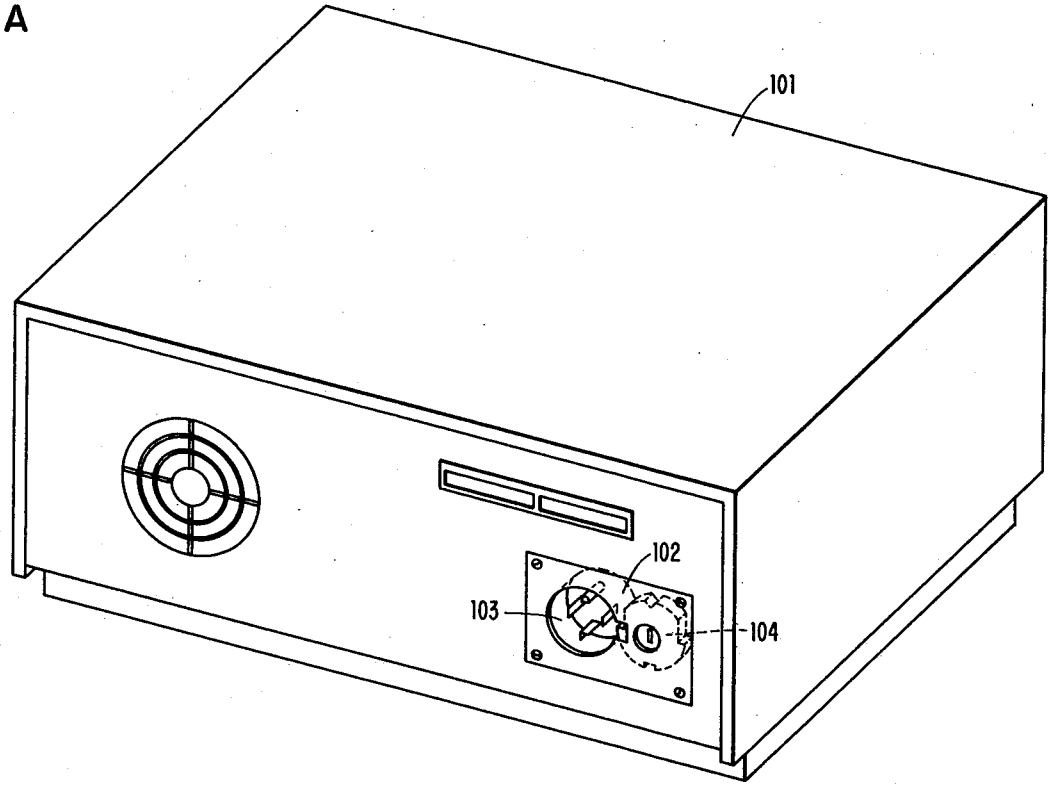
FIG. 1A illustrates a device incorporating the invention.

In FIG. 1A, an electrical device 101, such as a computer, amplifier, household appliance, etc., carries an electrical connector 102 for receiving electrical power supply voltage when an appropriate connector is inserted into a receptacle 103. A rotatable disc 104 defines insertable connectors, barring other connectors, in accordance with the particular supply voltage for which the device 101 is conditioned by the disc 104. Typically, electrical device 101 operates on a supply voltage of 115 VAC. Therefore, physically distinguishable connectors associated with supply voltages of, for example, 105 VAC, 115 VAC, 209 VAC, and 230 VAC, are insertable into the receptacle 103, depending upon the disc 104 position. As the disc 104 is rotated, the different connectors become insertable. Simultaneously, the device 101 is conditioned for the correspondingly different supply voltages. Actual voltage applied to circuits inside the device 101 therefore remains at, by way of example, approximately 115 VAC.

Figure 1B:
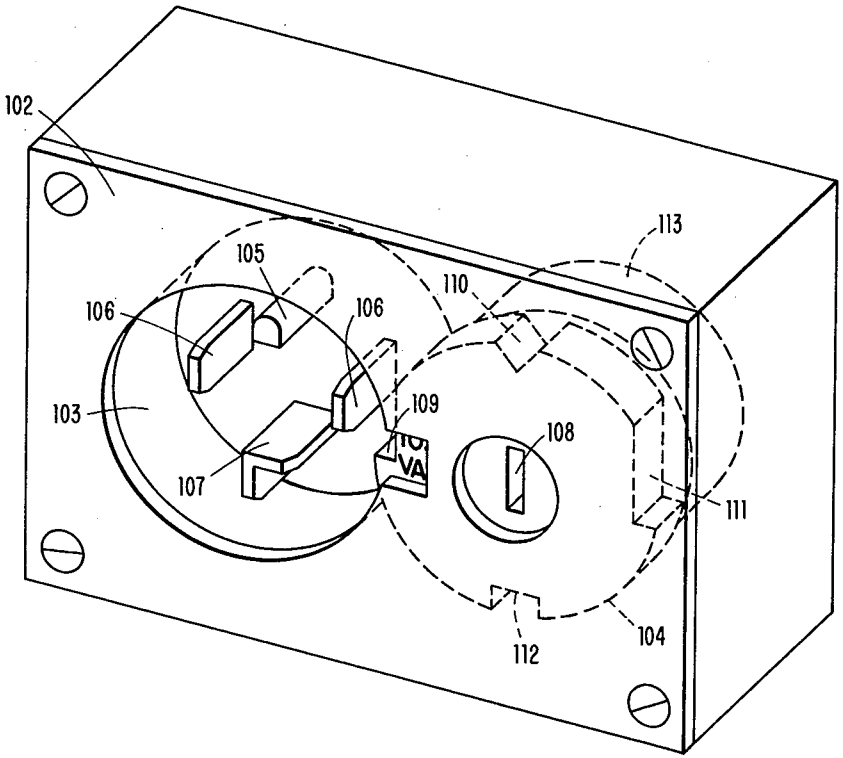
FIGS. 1B–1D show mechanical aspects of the device receptacle.
Figure 1D:
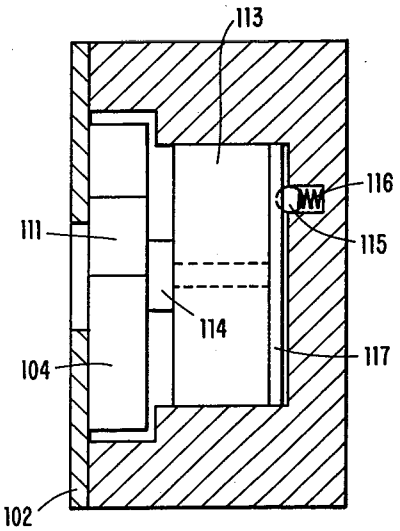
Figure 1C:
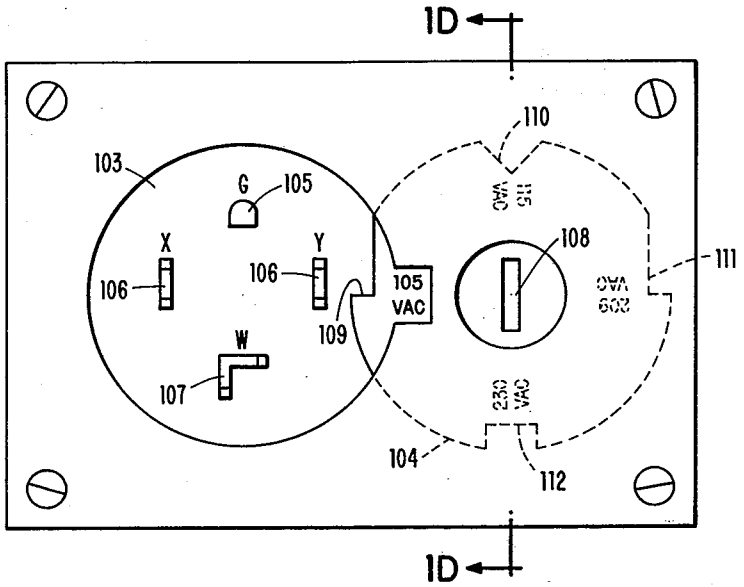

The electrical connector 102 of FIG. 1A appears in more detail in FIG. 1B. The receptacle 103 includes a grounding conductor 105, two phase conductors 106 and a neutral conductor 107 connectable to a mating socket arranged to receive the conductors 105–107. The disc 104 rotates peripheral keys 109–112 and a switch 113 when an operator turns a screwdriver slot 108 or otherwise grasps and turns the disc 104. One of keys 109–112 locks into position adjacent the receptacle 103 to mate with one socket and bar others. For example, in the position shown in FIG. 1B, a socket designed for a 105 VAC power supply mates with key 109. Additional power supply values appear on the view of disc 104 in FIG. 1C. FIG. 1D, which is section 1D, through FIG. 1C, shows how disc 104 rotation operates rotary switch 113. A shaft 114 connects disc 104 to switch rotor 117 which completes contacts, in a well known manner, as it steps through positions held by a ball detent 115 and spring 116.

Figure 2:
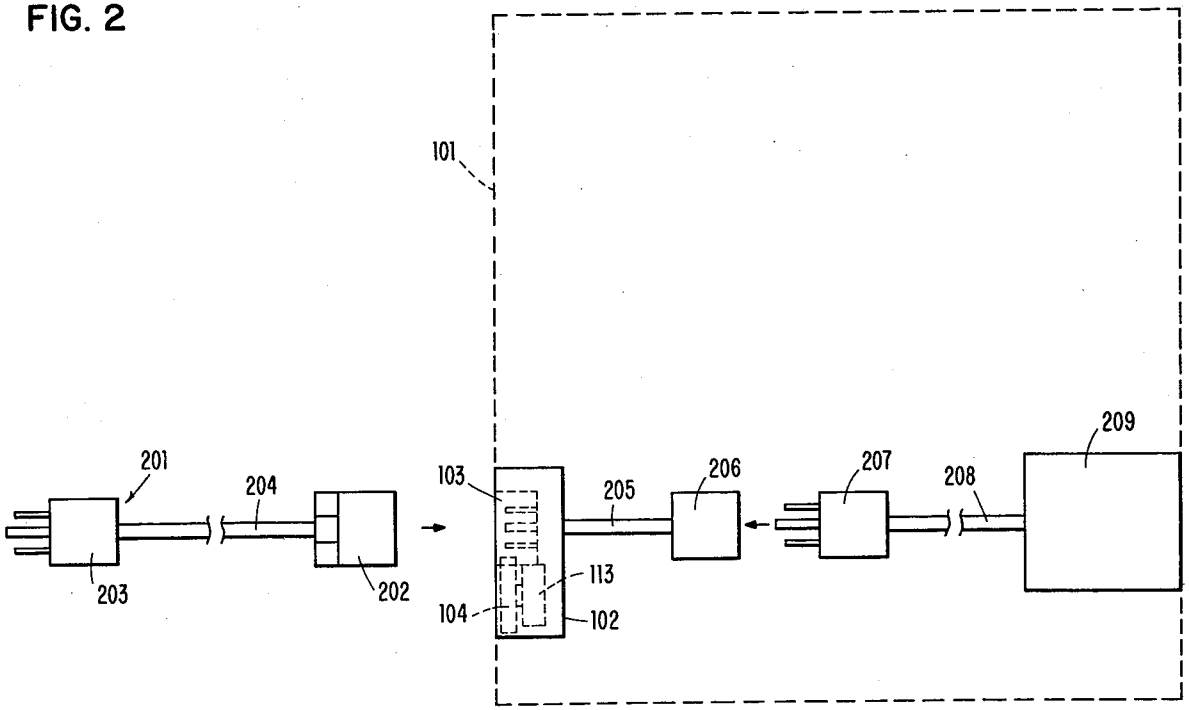
FIG. 2 shows the invention schematically.

FIG. 2 illustrates an electrical device 101 carrying an electrical connector 102. Receptacle 103 receives a mating keyed socket 202 connected to a wall plug 203 via a line cord 204 of a line-cord set 201. Receptacle 103 also connects to output cable 205 and output socket 206 through rotary switch 113. An output plug 207 is inserted into output socket 206 to ultimately connect cable 208 and utilization circuit 209 to power supply voltage at wall plug 203. The actual voltage applied to the utilization circuit 209 depends upon the position of disc 104 and the mating keyed socket 202 on line-cord set 201.

Figure 3:
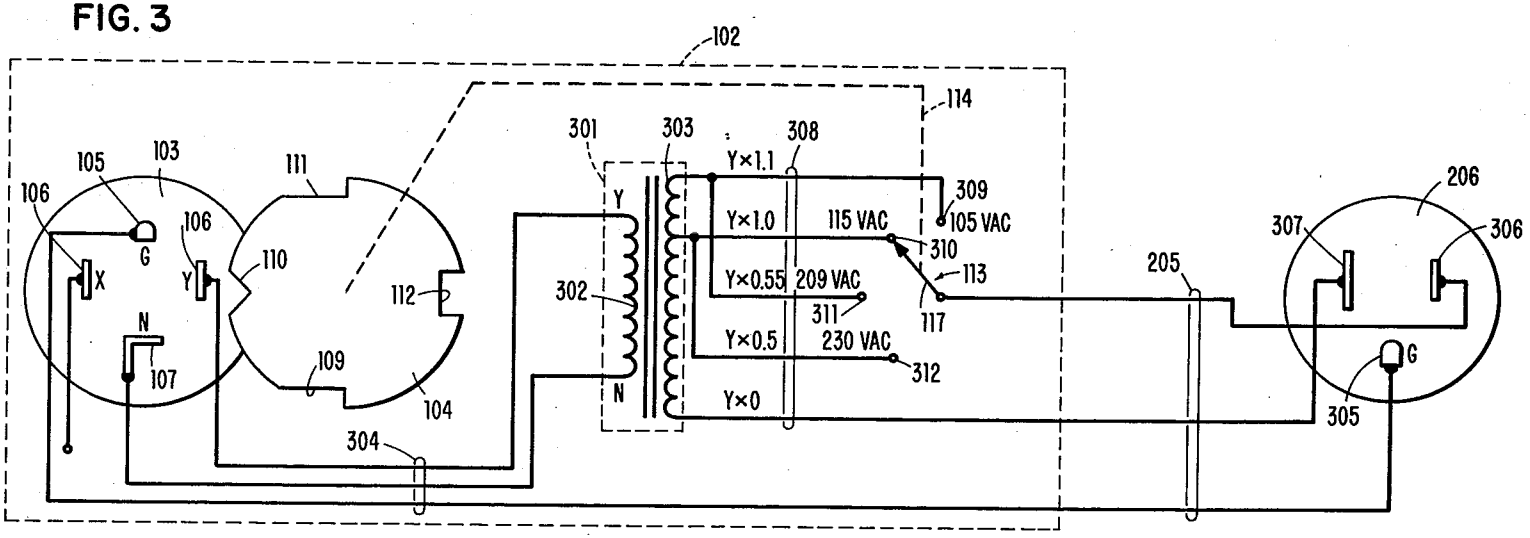
FIG. 3 details the variable voltage converter of FIG. 2. A second voltage converter embodiment appears in FIG. 4.
Figure 5:
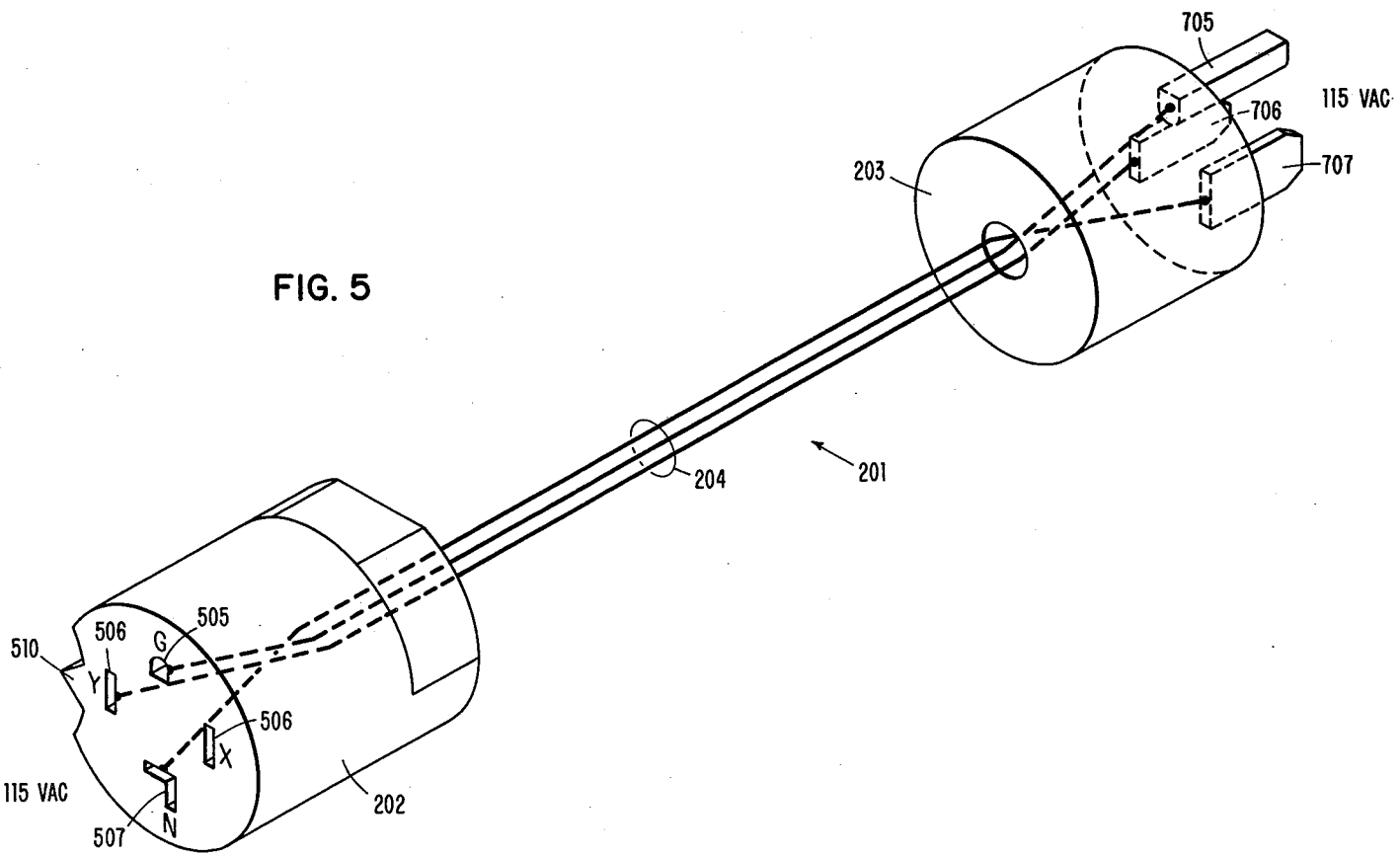
FIGS. 5 and 6 illustrate two line-cord sets usable in the invention.
Figure 6:
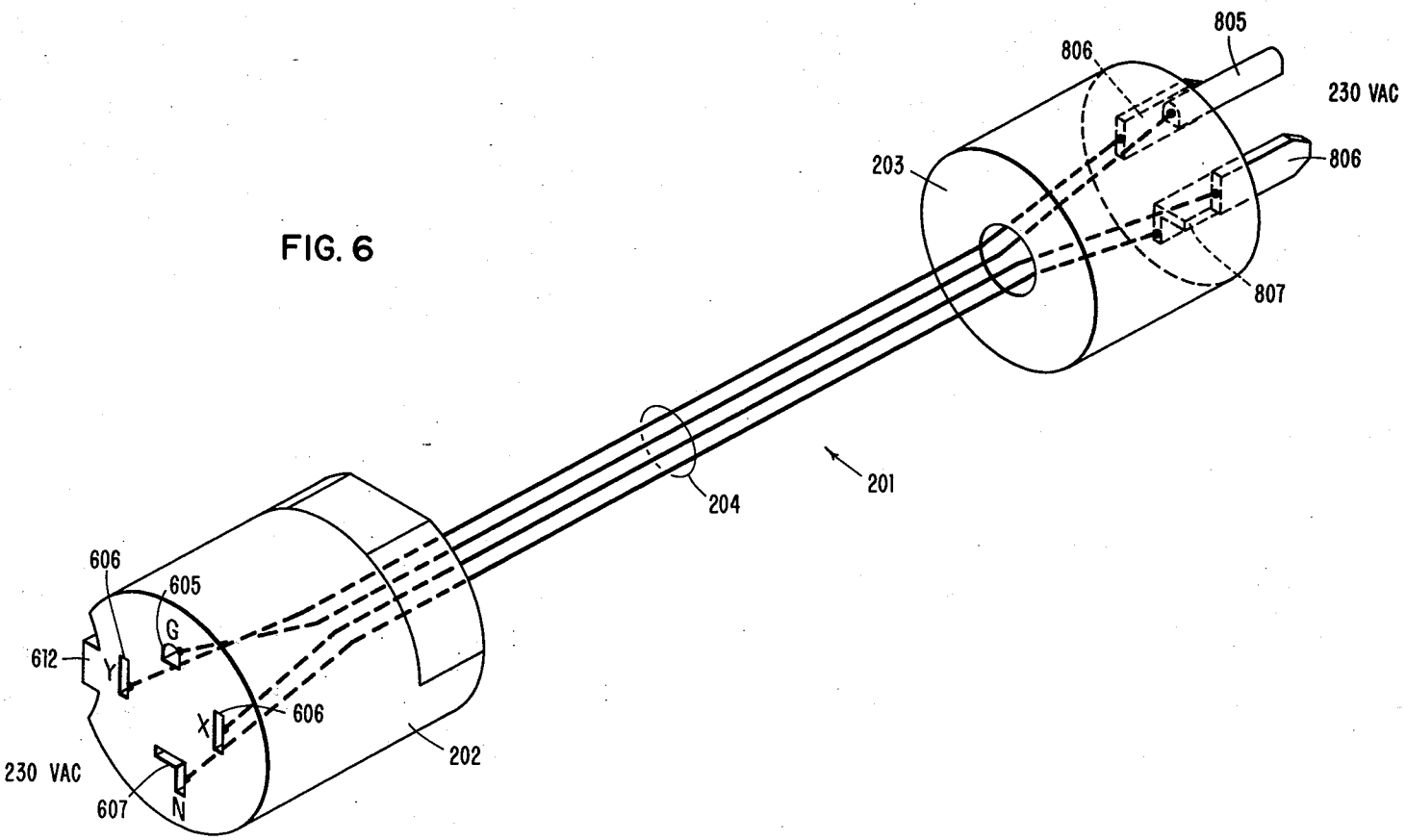

The receptacle 103 and disc 104 in FIG. 3 are arranged to receive a mating keyed socket 202 connected to a 115 VAC wall plug 203, as shown in FIG. 5. Rotation of the disc 104 two steps (in either direction) rearranges the receptacle to receive instead a socket 202 connected to a 230 VAC wall plug 203, as shown in FIG. 6. The choices of keys 109–112 and the corresponding voltages are arbitrary. In FIG. 3, the rotary switch 113, rotor 117, connects one at a time of switch contacts 309–312 to one wire in output cable 205 as disc 104 rotates switch shaft 114. Receptacle 103 phase conductors 106 supply power supply voltage (in this example, 115 VAC) from wall plug 203 to transformer 301 connected to rotary switch 113. In the example of FIG. 3, the 115 VAC line-cord set 201 keyed socket 202 (FIG. 5) could be inserted into the receptacle 103 only after the disc 104 was rotated to position switch rotor 117 at the 115 VAC switch contact 310. This switch contact 310 connects to a transformer 301 secondary 303 output Y×1 which provides the same voltage as was applied at transformer 301 primary 302 input Y connected to one of the phase conductors 106. If, instead, the 230 VAC line-cord set 201 (FIG. 6) had been used, the disc 104 would have positioned the rotor at the 230 VAC contact 312 connected to the same output Y×1. As a result, 230 VAC (between phase conductors 106) which is 115 VAC (between Y conductor 106 and conductor 107) appears as 115 VAC on the wire in output cable 205 connected to rotor 117. Similarly, 105 VAC, 115 VAC, 209 VAC or 230 VAC between the phase conductors 106 of receptacle 103 always appears as 115 VAC between phase conductor 306 and neutral conductor 307 of output socket 206; because, the disc 104 and therefore the rotor 117 must be appropriately moved to enable the receptacle 103 to receive the correspondingly keyed socket 202.

Figure 4:
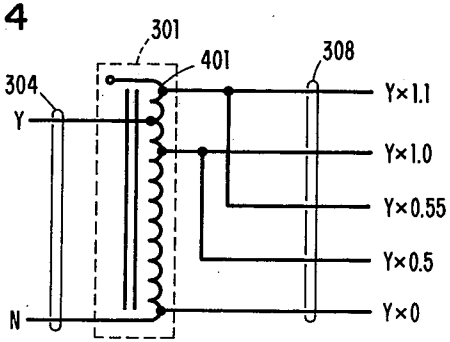

As shown in FIG. 3, the receptacle 103 neutral conductor 107 is connected to the transformer 301 primary 302. The Y conductor 106 connects to the other end of primary 302, while the X conductor 106 is not used. The ground conductor 105 may connect via output cable 205 to ground connector 305 of output socket 206. Other voltage conversion devices may be used in place of transformer 301. For example, the transformer 301 may be omitted or replaced by a "Y" or "Delta" wound transformer using both X and Y conductors 106. In FIG. 4, an autotransformer winding 401 connects to transformer 301 input wires 304 and output wires 308 in place of the device in FIG. 3.

FIGS. 5 and 6 illustrate two line-cord set 201 designs usable in the invention. In both FIGS. 5 and 6, keyed socket 202 and a wall plug 203 are connected together by a line cord 204. It is important that the socket, cord and plugs 202–204 be integrally formed, as by molding, to bar tampering. In FIG. 5, the wall plug 203 is intended for insertion into a 115 VAC wall socket, not shown, requiring a wall plug 203 with three connectors 705–707 arranged as shown. The corresponding keyed socket 202 115 VAC key 510 identifies the potentials present at conductors 505–507: 115 VAC between the Y phase conductor 506 and the neutral conductor 507. In the case of the line-cord set 201 in FIG. 6, 230 VAC appear between the Y and X phase conductors 606.

In operation, electrical device 101 is installed by choosing the line-cord set 201 that has a voltage designation matching the power supply voltage available, and a wall plug 203 which fits into the wall socket provided for that power supply voltage. The disc 104 is then rotated to line up the keys 109–112 corresponding to the selected voltage and the keyed socket 202 is inserted into the receptacle 103. The selected position of disc 104 provides a rotary switch 113 position that maintains the voltage at output socket 206 the same for widely different wall socket power supply voltages. If, for example, the wall plug 203 in FIG. 5 connects to 115 VAC, this voltage appears across conductors 706–707, 506–507 and 106(Y)–107 (FIG. 3). With rotor 117 in the position shown in FIG. 3, 115 VAC at the Y and neutral inputs of primary 302 of transformer 301, appears as 115 VAC at conductors 306–307. If instead, wall plug 203 in FIG. 6 connects to a 230 VAC power supply, this voltage appears in connectors 806, 606 and 106. However, rotor 117 now will be at contact 312 and 115 VAC still will appear at conductors 306–307.

While the invention has been particularly shown and described with reference to preferred embodiments thereof, it will be understood by those skilled in the art that various changes in form and details may be made therein without departing from the spirit and scope of the invention.

What is claimed is:

1. Apparatus for connecting an electrical device to a plurality of supply voltages, including:

a voltage converter, having a control, a voltage output connected to the device, and a voltage input, the converter being operable by the control to vary the input to output voltage ratio;

a plurality of line-cord sets each having a plug at one end mateable with a predefined supply voltage and a connector at the other end having a unique shape identifying the plug's supply voltage;

a voltage receptacle connected to the converter input for receiving one line-cord connector at a time; and mechanical keys, attached to the converter's control, each positionable to define a connector receivable by the receptacle and bar other connectors;

whereby, operation of the control to permit the receptacle to receive a connector varies the input to output voltage to provide substantially the same output voltage for different supply voltages.

2. The apparatus of claim 1 wherein the voltage converter is a multitap transformer connected to a switch moved in accordance with mechanical key positions to select different taps and, therefore, output voltages.

3. Apparatus for connecting an electrical device to a plurality of supply voltages, including:

a voltage converter, having a control, a voltage output connected to the device, and a voltage input, the converter being operable by the control to vary the input to output voltage ratio;

a plurality of line-cord sets each having a plug at one end mateable with a predefined supply voltage and a connector at the other end having a unique shape identifying the plug's supply voltage;

a voltage receptacle connected to the converter input for receiving one line-cord connector at a time; and mechanical keys, formed on the circumference of a disc attached to the converter's control, the disc being rotatable to bring one key at a time into a position to define a connector receivable by the receptacle and bar other connectors;

whereby, rotation of the disc operates the control to permit the receptacle to receive a connector, and varies the input to output voltage to provide substantially the same output voltage for different supply voltages.

4. The apparatus of claim 3 wherein the voltage converter is a multitap transformer connected to a switch moved in accordance with disc rotation to select different taps and, therefore, output voltages.

5. Apparatus for connecting an electrical device to any one of a plurality of supply voltages, including:

a voltage switch, having a manual control, a voltage output connected to the device, and a voltage input, the switch being operable by the manual control to vary the input to output voltage ratio;

a plurality of line-cord sets each having a plug at one end with pins mateable with a predefined voltage supply and a connector at the other end having a unique shape identifying the plug;

a voltage receptacle connected to the switch input for receiving one line-cord connector at a time; and indentations, formed on the circumference of a disc attached to the switch's manual control, the disc being rotatable to bring one indentation at a time into a position to mate with a connector shape receivable by the receptacle and to bar other connector shapes;

whereby, rotation of the disc permits the receptacle to receive one mating connector, and varies the input to output voltage to provide substantially one output voltage for different voltage supplies.

6. The apparatus of claim 5 wherein the voltage switch includes a transformer.

* * * * *